US011807959B2

(12) United States Patent
Kurouzu et al.

(10) Patent No.: US 11,807,959 B2
(45) Date of Patent: Nov. 7, 2023

(54) POLYAMIDE-610 MULTIFILAMENT

(71) Applicant: Toray Industries, Inc., Tokyo (JP)

(72) Inventors: Yoshihiro Kurouzu, Osaka (JP); Ikuo Matsutori, Okazaki (JP); Takashi Uruma, Okazaki (JP)

(73) Assignee: Toray Industries, Inc., Tokyo (JP)

( * ) Notice: Subject to any disclaimer, the term of this patent is extended or adjusted under 35 U.S.C. 154(b) by 142 days.

(21) Appl. No.: 16/975,420

(22) PCT Filed: Feb. 22, 2019

(86) PCT No.: PCT/JP2019/006913
§ 371 (c)(1),
(2) Date: Aug. 25, 2020

(87) PCT Pub. No.: WO2019/163971
PCT Pub. Date: Aug. 29, 2019

(65) Prior Publication Data

US 2021/0002790 A1 Jan. 7, 2021

(30) Foreign Application Priority Data

Feb. 26, 2018 (JP) ..... 2018-031834

(51) Int. Cl.
*D01F 6/60* (2006.01)

(52) U.S. Cl.
CPC ..... *D01F 6/60* (2013.01)

(58) Field of Classification Search
None
See application file for complete search history.

(56) References Cited

U.S. PATENT DOCUMENTS

| | | | | |
|---|---|---|---|---|
| 2009/0281210 | A1* | 11/2009 | Aramaki | C08L 77/00 524/413 |
| 2011/0020628 | A1 | 1/2011 | Fukudome et al. | |
| 2013/0231454 | A1 | 9/2013 | Kestner et al. | |
| 2017/0311651 | A1 | 11/2017 | Yoshioka et al. | |
| 2018/0327933 | A1 | 11/2018 | Sato et al. | |

FOREIGN PATENT DOCUMENTS

| | | | |
|---|---|---|---|
| CN | 107177903 | A | 9/2017 |
| GB | 574956 | A | 1/1946 |
| JP | 55-84417 | A | 6/1980 |
| JP | 60-9910 | A | 1/1985 |
| JP | 01-315463 | A | 12/1989 |
| JP | 03-027118 | A | 2/1991 |
| JP | 6-158428 | A | 6/1994 |
| JP | H0881822 | * | 3/1996 |

(Continued)

OTHER PUBLICATIONS

Machine translation of JPH0881822 (Year: 1996).*

(Continued)

*Primary Examiner* — Shawn Mckinnon
(74) *Attorney, Agent, or Firm* — DLA Piper LLP (US)

(57) ABSTRACT

A polyamide-610 filament has high strength and excels in fluff quality. The polyamide-610 multifilament has a sulfuric acid relative viscosity of 3.3-3.7, a strength of 7.3-9.2

(Continued)

cN/dtex, and an elongation of 20-30%, wherein the number of fluffs is 9/10000 m to 4/10000 m and a total fineness is 420 dtex to 1500 dtex.

17 Claims, 1 Drawing Sheet

(56) References Cited

FOREIGN PATENT DOCUMENTS

| | | | | |
|---|---|---|---|---|
| JP | 2000-303254 | A | | 10/2000 |
| JP | 2004-270085 | A | | 9/2004 |
| JP | 2007-136571 | A | | 6/2007 |
| JP | 2011-1635 | A | | 1/2011 |
| JP | 2012251263 | | * | 12/2012 |
| JP | 2014/167183 | A | | 9/2014 |
| TW | 200949029 | A | | 12/2009 |
| TW | 201636466 | A | | 10/2016 |
| WO | 2011/066620 | A1 | | 6/2011 |
| WO | 2017/082255 | A1 | | 5/2017 |

OTHER PUBLICATIONS

Machine translation of JP2012251263 (Year: 2012).*

Toy, F.C. et al, "Developments in Nylon 66 and 610 Fibres," *Journal of the Textile Institute Proceedings*, vol. 47, No. 8, pp. 582-597, XP055851082, Great Britain, Aug. 1, 1956.

Extended European Search Report dated Oct. 22, 2021, of counterpart EP Application No. 19 75 7157.3, along with an English translation.

Notification for the Opinion of Examination dated Mar. 31, 2022, of counterpart Taiwanese Patent Application No. 108106446, along with an English translation.

Notice of Reasons for Refusal dated Oct. 4, 2022, of counterpart Japanese Patent Application No. 2019-521503, along with an English translation.

Request for the Submission of an Opinion dated May 30, 2023, of counterpart Korean Patent Application No. 10-2020-702965, along with an English translation.

The First Office Action dated Jun. 21, 2022, of counterpart Chinese Patent Application No. 201980014363.1, along with an English translation.

* cited by examiner

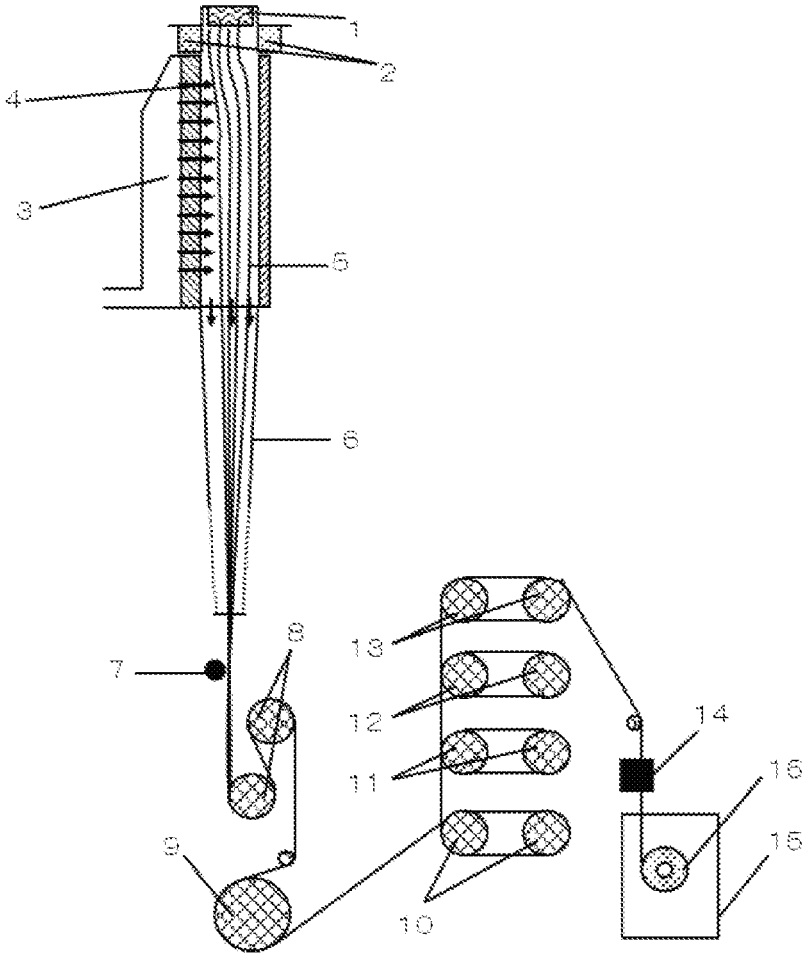
1
2
4
3
5
6
7
8
9
13
12
11
10
14
16
15

POLYAMIDE-610 MULTIFILAMENT

TECHNICAL FIELD

This disclosure relates to a polyamide 610 multifilament.

BACKGROUND

Multifilaments of polyamide 6 or polyamide 66 have high strength-elongation product and excellent fluff quality, compared to general-purpose multifilaments such as polyester, polypropylene or the like and, therefore, have been used in a wide variety of applications such as air bags, guts for sports rackets, ropes, fishing nets and belts for bags.

In general, a polyamide is a polymer having water- and moisture-absorbing properties. In a multifilament of a so-called general-purpose polyamide such as polyamide 6 or polyamide 66, water absorption causes a large decrease in strength or moisture absorption causes a large dimensional change.

In marine applications such as marine ropes and fishing nets, the decrease in strength caused by water absorption has often become a problem, and in bag woven fabrics or belts for bags, there has been a problem that the so-called "puckering" phenomenon of wrinkle occurrence on the fabric by the dimensional change due to repetition of wetting-drying occurs.

On the other hand, polyamide 11, polyamide 610, 612 and the like are known as low water-absorbing polyamide multifilaments, and proposed, for example, as washing brush fiber (JP-A-2011-1635). However, those polyamide multifilaments produced by conventional methods have low strength and poor fluff quality compared to polyamide 6 and polyamide 66. They have therefore been difficult to be developed into the applications essentially requiring high strength such as the marine ropes, and into the applications essentially requiring high strength and excellent fluff quality such as the bag woven fabrics and the belts for bags.

It could therefore be helpful to provide a low water-absorbing polyamide 610 multifilament having high strength and excellent fluff quality, to make the most of the features of a polyamide 610 multifilament due to water absorption and moisture absorption as described above, and to make it possible to further expand the applications of the polyamide 610 multifilament.

SUMMARY

We thus provide:

(1) A polyamide 610 multifilament having a sulfuric acid relative viscosity of 3.3 to 3.7, a strength of 7.3 cN/dtex to 9.2 cN/dtex and an elongation of 20% to 30%.

(2) The polyamide 610 multifilament according to (1), in which the number of fluffs is from $^{0}/_{10000}$ m to $^{4}/_{10000}$ m.

(3) The polyamide 610 multifilament according to (1) or (2), in which a total fineness is from 420 dtex to 1500 dtex.

(4) The polyamide 610 multifilament according to any one of (1) to (3), in which the wet tenacity/dry tenacity is 0.90 or more.

A polyamide 610 multifilament having strength and fluff quality similar to those of a polyamide 6 or polyamide 66 multifilament can be provided, and it becomes possible to further expand the applications of the polyamide 610 multifilament.

BRIEF DESCRIPTION OF THE DRAWING

FIG. 1 is a schematic view of a preferred direct spinning-drawing apparatus.

DESCRIPTION OF REFERENCE NUMERALS AND SIGNS

1: Spinneret
2: Heating cylinder
3: Cross flow cooling equipment
4: Cooling air
5: Yarn
6: Duct
7: Oiling device
8: Take-up rollers
9: Yarn feed roller
10: First drawing rollers
11: Second drawing rollers
12: Third drawing rollers
13: Relaxation rollers
14: Interlacing device
15: Winder
16: Yarn package

DETAILED DESCRIPTION

A raw material used for a polyamide 610 multifilament is polyamide 610.

The sulfuric acid relative viscosity (referred to as the viscosity) of raw material chips (referred to as chips) for the polyamide 610 multifilament is preferably 3.6 to 4.0, more preferably 3.7 to 3.9, and still more preferably 3.7 to 3.8. When the viscosity of the chips is 3.6 or more, the polyamide 610 multifilament having a viscosity specified herein is stably and easily obtained when the moisture percentage of the chips falls within our specified range.

The moisture percentage of the chips of polyamide 610 used as the raw material for the polyamide 610 multifilament is preferably 0.05% or more, particularly preferably 0.05% to 0.13%, and more preferably 0.07% to 0.09%. Since polyamide 610 is hard to absorb water, it is suggested that polyamide 610 is less affected by the moisture percentage. However, we were surprised that the viscosity of the polyamide 610 multifilament to be obtained could be adjusted by adjusting the moisture percentage of the chips, resulting in a dramatic improvement of strength-elongation product and fluff quality. When the moisture percentage of polyamide 610 is less than 0.05%, the fluff quality is deteriorated. A method of adjusting the moisture percentage of polyamide 610 is preferably a method of drying the chips, or a method of adding measured water to the chips after drying, and stirring the chips. However, the method may be any as long as the above-mentioned range is achieved.

The moisture percentage was measured by using a combined device of AQ-2200 of HIRANUMA SANGYO and EV-2000 of HIRANUMA SANGYO.

The polyamide 610 multifilament has a sulfuric acid relative viscosity of 3.3 to 3.7, a strength of 7.3 cN/dtex to 9.2 cN/dtex, and an elongation of 20% to 30%.

It is necessary that the polyamide 610 multifilament has a sulfuric acid relative viscosity of 3.3 to 3.7, and the sulfuric acid relative viscosity is preferably 3.3 to 3.6, and more preferably 3.4 to 3.6. When the sulfuric acid relative viscosity is less than 3.3, a yarn having sufficient strength with good fluff quality cannot be obtained, and when the sulfuric acid relative viscosity is more than 3.7, spinnability and the fluff quality are deteriorated.

The sulfuric acid relative viscosity means a value obtained by dissolving a specimen in 98% sulfuric acid and performing measurement at 25° C. by using an Ostwald viscometer.

It is necessary that the polyamide 610 multifilament has a strength of 7.3 cN/dtex to 9.2 cN/dtex, and the strength is preferably 8.0 cN/dtex to 9.2 cN/dtex, and more preferably 8.3 cN/dtex to 9.2 cN/dtex, and still more preferably 8.3 cN/dtex to 8.9 cN/dtex. That is, when a high-strength yarn is produced by a usual method, fluff (oftentimes also referred to as "fluffs") is easily generated. However, fluff generation, yarn breakage and the like in spinning and drawing steps are prevented by adjustment of the moisture percentage and optimization of the viscosity of the polyamide 610 chips, and a high-quality polyamide 610 multifilament can be obtained.

In addition, it is necessary that the polyamide 610 multifilament has an elongation of 20 to 30%, and the elongation is more preferably 20% to 25%. In particular, in the polyamide 610 multifilament having a strength falling in the above-mentioned range and an elongation falling in such a range, the effects are particularly effectively exerted, and fluff generation, yarn breakage and the like are prevented. Thus, an extremely high-quality polyamide 610 multifilament is obtained.

Although depending on the total fineness and the number of single filament fineness, the strength-elongation product is preferably 35 cN/dtex×√% or more, more preferably 39 cN/dtex×√% or more, and still more preferably 40 cN/dtex×√% or more. Fluff generation, yarn breakage and the like are prevented because the strength-elongation product is high, and the extremely high-quality polyamide 610 multifilament is obtained even when it has high strength. The strength (cN/dtex) and the elongation (%) refer values measured under constant-rate extension conditions shown in JIS L1013 (1999) 8.5.1. Standard Test, and the strength-elongation product is a value calculated by strength×√(elongation).

The number of single filament fineness is more preferably 4 dtex to 35 dtex. When the number of single filament fineness is 4 dtex to 35 dtex, a high-strength polyamide 610 multifilament can be stably produced while maintaining the quality. The number of single filaments is not particularly specified, and it is the number of single filament fineness that is important.

In the polyamide 610 multifilament, the total fineness is preferably 420 dtex to 1500 dtex, more preferably 450 dtex to 1200 dtex, and still more preferably 450 dtex to 1050 dtex. The lower the total fineness is, the more the cooling efficiency is enhanced. Therefore, the yarn production can be performed in the good fluff quality.

The total fineness means a value obtained by measuring the positive amount fineness based on corrected weight under a predetermined load of 0.045 cN/dtex according to JIS L1013 (1999) 8.3.1A Method.

In the polyamide 610 multifilament, the number of fluffs is preferably 0/10000 m to 4/10000 m, and particularly preferably 0/10000 m to 3/10000 m, and more preferably 0/10000 m to 2/10000 m. The number of fluffs being small enables expansion of the multifilament into the applications requiring the excellent fluff quality such as the bags.

The number of fluffs means a value obtained by measuring the total number of fluffs over a filament length of 10000 m or more while rewinding the multifilament at a speed of 500 m/min and converting it to the number per 10000 m.

In the polyamide 610 multifilament, the wet tenacity/dry tenacity is preferably 0.90 or more, particularly preferably 0.95 or more, and more preferably 0.98 or more. When the wet tenacity/dry tenacity is 0.90 or more, a reduction in wet tenacity can be prevented compared to polyamide 6 or polyamide 66 which is a general-purpose polyamide, and a reduction in tenacity in the aqueous applications such as marine ropes and fishing nets can be prevented.

The wet tenacity/dry tenacity can be calculated from values measured under constant-rate extension conditions shown in JIS L1013 (1999) 8.5.1. Standard Test, and means a value calculated by a method described in the Examples.

A method of producing the polyamide 610 multifilament is described below. The polyamide 610 multifilament can be preferably produced by the following method, based on usual melt spinning. Still more preferably, when the polyamide 610 multifilament is produced by a direct spinning-drawing method, it is particularly effective. In addition, when the melt spinning is performed, it is preferable to control the viscosity of the chips, and then to give a predetermined amount of water, to improve the strength-elongation product. The improved strength-elongation product make it possible to prevent yarn breakage or fluff occurrence during drawing. As a result, the polyamide 610 multifilament having high strength and excellent quality can be obtained.

The method is described below with FIG. 1 taken as an example.

FIG. 1 is a schematic view of a preferred direct spinning-drawing apparatus.

Polyamide 610 chips are melted and kneaded in an extruder type spinning machine (not shown in FIG. 1), and discharged from a spinneret 1 in a spinning part to be spun. A yarn 5 spun from the spinneret 1 passes through a heating cylinder 2, and cooled with a cooling air 4 by a cross flow cooling equipment 3. The cooled yarn 5 passes through a duct 6, and is taken up by take-up rollers 8 while a treating agent being given to it by an oiling device 7. The taken-up yarn 5 is subjected to pre-stretch drawing between the take-up rollers 8 and a yarn feed roller 9. Thereafter, three-stage drawing is performed on first drawing rollers 10, second drawing rollers 11 and third drawing rollers 12, and relaxation is performed on relaxation rollers 13. The yarn 5 subjected to the relaxation is interlaced by an interlacing device 14, and wound up by a winder 15 to form a yarn package 16.

The viscosity of the above-mentioned polyamide 610 chips is preferably from 3.6 to 4.0.

The take-up speed when the yarn is taken up in the above is preferably 350 to 1100 m/min. The treating agent is preferably a non-aqueous treating agent. However, even when an aqueous treating agent is used, sufficient physical properties are obtained. The means for delivering/applying the treating agent is preferably an oiling device or guide oiling.

For steps from the drawing to the winding, a method in which multistage drawing, usually two or more stages, is conducted followed by relaxation treatment and winding, is preferred, and the multistage drawing is preferably three or more-stage drawing. In two or more-stage drawing, it is preferred that pre-stretch drawing is conducted and then drawing is conducted. In the pre-stretch drawing and the first stage drawing, it is preferred that hot drawing is performed at about the glass transition temperature, and the remaining drawing is performed at a high temperature of usually 150°

C. to 220° C., more preferably at 170° C. to 210° C. An increase in the number of drawing stages makes the time for which the multifilament is treated at a temperature equivalent to or higher than the crystallization temperature longer. The longer the treatment time becomes, the more the crystallization of polymer chains in the yarn is promoted. Therefore, the high-strength multifilament can be produced.

The draw ratio, that is, the draw ratio between the take-up rollers 8 and the third drawing rollers 12, is usually 3 to 6. Usually, the winding speed is preferably 2000 m/min to 5000 m/min, and more preferably 2500 m/min to 4500 m/min. In addition, the yarn is preferably wound up into a cheese form by the winder under conditions of a winding tension of 20 gf to 250 gf.

By the method as described above, the polyamide 610 multifilament can be produced.

The polyamide 610 multifilament can be suitably used for various applications, for example, marine applications such as marine ropes and fishing nets and bag applications such as bag woven fabrics and belts for bags.

EXAMPLES

Our multifilaments and methods are described in detail below with reference to examples, but this disclosure is not limited by these examples in any way. Methods of measuring respective measured values in the examples are as follows:

(1) Sulfuric acid relative viscosity (ηr): Using polymer chips or a yarn as a specimen, 0.25 g of the specimen was dissolved in 25 ml of 98% sulfuric acid, and measurement was performed at 25° C. by using an Ostwald viscometer. The viscosity was determined from the following formula. The measured value was determined from an average value of 5 specimens.

$\eta r$=(flow-down seconds of specimen solution)/(flow-down seconds of only sulfuric acid)

(2) Moisture percentage: Measurement was performed by using AQ-2200 of HIRANUMA SANGYO and EV-2000 of HIRANUMA SANGYO in combination. That is, moisture in specimen chips was extracted by using EV-2000 of HIRANUMA SANGYO, and the moisture percentage was measured by using AQ-2200 of HIRANUMA SANGYO. The amount of the specimen was 1.5 g, and 0.2 L/min of nitrogen was used for moisture vaporization.

Measurement conditions were as follows:

Step 1: temperature: 210° C., time: 21 min

Blank baking time: 0 min

Termination B.G.: 0 μg

Cooling time: 1 min

B.G. stable number of times: 30 times

Back purge time: 20 sec.

(3) Total fineness: The total fineness was obtained by measuring the positive amount fineness based on corrected weight under a predetermined load of 0.045 cN/dtex according to JIS L1013 (1999) 8.3.1A Method.

(4) Number of single filaments: Calculated by the method of JIS L1013 (1999) 8.4.

(5) (Dry) tenacity-strength-elongation: Measurement was performed under constant-rate extension conditions shown in JIS L1013 (1999) 8.5.1. Standard Test. The specimen was subjected to the test at a grip distance of 25 cm and an extension rate of 30 cm/min using "Tensilon" UCT-100 manufactured by Orientec Co., Ltd. The tenacity was determined from the maximum tenacity in the S-S curve, the elongation was determined from the elongation at the point showing the maximum tenacity in the S-S curve, and the strength was determined by dividing the tenacity by the total fineness.

(6) Number of fluffs in yarn production: The yarn package obtained was rewound at a speed of 500 m/min, a laser type fluff detector "Flytech V" manufactured by Heberlein was installed 2 m away from the yarn during rewinding, and the total number of fluffs detected was evaluated. The evaluation was performed for 10000 m or more, and the total number was converted to the number per 10000 m, which was indicated as the number of fluffs.

(7) Number of fluffs at 8.7 cN/dtex: Aside from the yarn produced in each example and comparative example, a yarn having a strength of 8.7 cN/dtex was made of the same chips as used in each example and comparative example. The package obtained was rewound at a speed of 500 m/min, the laser type fluff detector "Flytech V" manufactured by Heberlein was installed 2 m away from the yarn during rewinding, and the total number of fluffs detected was evaluated. The evaluation was performed for 10000 m or more, and the total number was converted to the number per 10000 m, which was indicated as the number of fluffs.

This evaluation is to compare the number of fluffs on the same level by making the strength the same because there is a strong tendency that the number of fluffs generally depends on the strength in the yarn. The yarn having a strength of 8.7 cN/dtex was made, with the same total fineness and the number of filaments, appropriately adjusting spinning, drawing and relaxation heat treating conditions and the like.

(8) Wet tenacity: Tenacity retention at the time of water absorption: A small hank having a predetermined yarn length was made according to JIS L1013 (1999) 8.3.1A method, and the small hank was immersed in tap water at 20° C. for 24 hours. After an elapse of 24 hours, the small hank was taken out, and within 10 minutes, measurement was performed under constant-rate extension conditions shown in JIS L1013 (1999) 8.5.1. Standard Test.

(9) Wet tenacity/dry tenacity: A value obtained by dividing the wet tenacity (measured in item (8) described above) by the dry tenacity (measured in item (5) described above).

Examples 1 to 9 and Comparative Examples 1 to 3

A 5 wt % aqueous solution of copper acetate was added as an antioxidant to polyamide 610 chips obtained by liquid phase polymerization, and mixed. An amount of 70 ppm relative to the polymer weight in terms of copper amount was adsorbed. Then, a 50 wt % aqueous solution of potassium iodide and a 20 wt % aqueous solution of potassium bromide were each added to achieve an adsorption of an amount of 0.1 parts by weight relative to 100 parts by weight of the polymer chips in terms of potassium amount. Using a solid phase polymerization equipment, solid phase polymerization was performed to the polymer chips, and thereafter, water was added to obtain polyamide 610 pellets having a sulfuric acid relative viscosity and a moisture percentage shown in Tables 1 or 2.

The apparatus shown in FIG. 1 was used as a spinning apparatus. The polyamide 610 pellets described above were supplied to an extruder, and the discharge rate was adjusted by a measuring pump to achieve a total fineness of about 470 dtex. The spinning temperature was 285° C., and after filtration through a metal nonwoven fabric filter in a spinning pack, spinning was performed through a 48-hole spinneret. A spinning yarn was allowed to pass through a heating cylinder heated at a temperature of 250° C., and thereafter, solidified by cooling with cooling air at an air speed of 40 m/min. A treating agent was given to the yarn solidified by cooling, and the yarn was turned around spinning take-up rollers to take up the yarn at a spinning speed shown in Tables 1 and 2. Thereafter, the taken-up yarn was drawn 5% between the take-up rollers 8 and a yarn feed roller 9 without once being wound up. Then, a first stage drawing was performed between the yarn feed roller 9 and first drawing rollers 10 to attain a rotational speed ratio of 2.7 therebetween, and subsequently, a second stage drawing was performed between the first drawing rollers 10 and second drawing rollers 11 to attain a rotational speed ratio of 1.4 therebetween. Subsequently, a third stage drawing was performed between the second drawing rollers 11 and third drawing rollers 12.

Subsequently, 8% relaxation heat treatment was conducted between the third drawing rollers 12 and relaxation rollers 13, and the yarn was interlaced by an interlacing device, and thereafter, wound up by a winder 15. The surface temperatures of the respective rollers were set to ordinary temperature for the take-up rollers, 40° C. for the yarn feed roller, 95° C. for the first drawing rollers, 150° C. for the second drawing rollers, 202° C. for the third drawing rollers and 150° C. for the relaxation rollers. The interlacing treatment was performed by injecting high-pressure air from a direction perpendicular to the travelling yarn in the interlacing device. Guides for regulating the travelling yarn were provided before and after the interlacing device, and the pressure of the air to be injected was constant at 0.2 MPa.

Example 10

A yarn was produced in the same manner as in Example 1, except that using polyamide 610 pellets having a sulfuric acid relative viscosity and a moisture percentage shown in Table 2, the discharge rate was adjusted by the measuring pump to a total fineness shown in Table 2, that spinning was performed through a 204-hole spinneret, and that the spinning speed and the draw ratio were changed as shown in Table 2.

Example 11

A yarn was produced in the same manner as in Example 1, except that using polyamide 610 pellets having a sulfuric acid relative viscosity and a moisture percentage shown in Table 2, the discharge rate was adjusted by the measuring pump to a total fineness shown in Table 2, that spinning was performed through a 204-hole spinneret, and that the spinning speed was changed as shown in Table 2.

Example 12

A yarn was produced in the same manner as in Example 1, except that using polyamide 610 pellets having a sulfuric acid relative viscosity and a moisture percentage shown in Table 2, the discharge rate was adjusted by the measuring pump to a total fineness shown in Table 2, that spinning was performed through a 306-hole spinneret, and that the spinning speed and the draw ratio were changed as shown in Table 2.

Example 13

Polyamide 610 pellets having a sulfuric acid relative viscosity and a moisture percentage shown in Table 2 were used.

The apparatus shown in FIG. 1 was used as a spinning apparatus. The polyamide 610 pellets described above were supplied to the extruder, and the discharge rate was adjusted by the measuring pump to achieve a total fineness of about 875 dtex. The spinning temperature was 265° C., and after filtration through a metal nonwoven fabric filter in a spinning pack, spinning was performed through a 28-hole spinneret. A spinning yarn was allowed to pass through the heating cylinder heated at a temperature of 235° C. and, thereafter, solidified by cooling with cooling air at an air speed of 45 m/min. The treating agent was given to the yarn solidified by cooling, and the yarn was turned around the spinning take-up rollers to take up the yarn at a spinning speed shown in Table 2. Thereafter, the taken-up yarn was drawn 8% between the take-up rollers 8 and the yarn feed roller 9 without once being wound up. Then, a first stage drawing was performed between the yarn feed roller 9 and the first drawing rollers 10 to attain a rotational speed ratio of 2.7 therebetween and, subsequently, a second stage drawing was performed between the first drawing rollers 10 and the second drawing rollers 11 to attain a rotational speed ratio of 1.3 therebetween. Subsequently, a third stage drawing was performed between the second drawing rollers 11 and the third drawing rollers 12.

Subsequently, 10% relaxation heat treatment was conducted between the third drawing rollers 12 and the relaxation rollers 13, and the yarn was interlaced by the interlacing device and, thereafter, wound up by the winder 15. The surface temperatures of the respective rollers were set to ordinary temperature for the take-up rollers, 55° C. for the yarn feed roller, 95° C. for the first drawing rollers, 150° C. for the second drawing rollers, 205° C. for the third drawing rollers and 140° C. for the relaxation rollers. The interlacing treatment was performed by injecting high-pressure air from a direction perpendicular to the travelling yarn in the interlacing device. The guides for regulating the travelling yarn were provided before and after the interlacing device, and the pressure of the air to be injected was constant at 0.2 MPa.

Reference Example 1

A 5 wt % aqueous solution of copper acetate was added as an antioxidant to polyamide 66 chips obtained by liquid phase polymerization, and mixed, and an amount of 68 ppm relative to the polymer weight in terms of copper amount was adsorbed. Then, a 50 wt % aqueous solution of potassium iodide and a 20 wt % aqueous solution of potassium bromide were each added to achieve an adsorption of an amount of 0.1 parts by weight relative to 100 parts by weight of the polymer chips in terms of potassium amount. Using a solid phase polymerization equipment, solid phase polymerization was performed to the polymer chips and, thereafter, water was added to obtain polyamide 66 pellets having a sulfuric acid relative viscosity and a moisture percentage shown in Table 2.

The apparatus shown in FIG. 1 was used as a spinning apparatus. The polyamide 66 pellets described above were supplied to the extruder, and the discharge rate was adjusted by the measuring pump to achieve a total fineness of about 1400 dtex. The spinning temperature was 295° C., and after filtration through a metal nonwoven fabric filter in a spinning pack, spinning was performed through a 204-hole spinneret. A spinning yarn was allowed to pass through the heating cylinder heated at a temperature of 280° C. and, thereafter, solidified by cooling with cooling air at an air speed of 33 m/min. The treating agent was given to the yarn solidified by cooling, and the yarn was turned around the spinning take-up rollers to take up the yarn at a spinning speed shown in Table 2. Thereafter, the taken-up yarn was drawn 3% between the take-up rollers 8 and the yarn feed roller 9 without once being wound up. Then, a first stage drawing was performed between the yarn feed roller 9 and the first drawing rollers 10 to attain a rotational speed ratio of 2.8 therebetween, and subsequently, a second stage drawing was performed between the first drawing rollers 10 and the second drawing rollers 11 to attain a rotational speed ratio of 1.3 therebetween. Subsequently, a third stage drawing was performed between the second drawing rollers 11 and the third drawing rollers 12.

Subsequently, 8% relaxation heat treatment was performed between the third drawing rollers 12 and the relaxation rollers 13, and the yarn was interlaced by the interlacing device and, thereafter, wound up by the winder 15. The surface temperatures of the respective rollers were set to ordinary temperature for the take-up rollers, 54° C. for the yarn feed roller, 140° C. for the first drawing rollers, 205° C. for the second drawing rollers, 228° C. for the third drawing rollers and 144° C. for the relaxation rollers. The interlacing treatment was performed by injecting high-pressure air from a direction perpendicular to the travelling yarn in the interlacing device. The guides for regulating the travelling yarn were provided before and after the interlacing device, and the pressure of the air to be injected was constant at 0.3 MPa.

Reference Example 2

A 5 wt % aqueous solution of copper acetate was added as an antioxidant to polyamide 6 chips obtained by liquid phase polymerization and mixed. An amount of 68 ppm relative to the polymer weight in terms of copper amount was adsorbed. Then, a 50 wt % aqueous solution of potassium iodide and a 20 wt % aqueous solution of potassium bromide were each added to achieve an adsorption of an amount of 0.1 parts by weight relative to 100 parts by weight of the polymer chips in terms of potassium amount. Using a solid phase polymerization equipment, solid phase polymerization was performed to the polymer chips and, thereafter, water was added to obtain polyamide 6 pellets having a sulfuric acid relative viscosity and a moisture percentage shown in Table 2.

The apparatus shown in FIG. 1 was used as a spinning apparatus.

The polyamide 6 pellets described above were supplied to the extruder, and the discharge rate was adjusted by the measuring pump to achieve a total fineness of about 1400 dtex. The spinning temperature was 285° C., and after filtration through a metal nonwoven fabric filter in a spinning pack, spinning was performed through a 204-hole spinneret. A spinning yarn was allowed to pass through the heating cylinder heated at a temperature of 290° C. and, thereafter, solidified by cooling with cooling air at an air speed of 30 m/min. The treating agent was given to the yarn solidified by cooling, and the yarn was turned around the spinning take-up rollers to take up the yarn at a spinning speed shown in Table 2. Thereafter, the taken-up yarn was drawn 9% between the take-up rollers 8 and the yarn feed roller 9 without once being wound up. Then, a first stage drawing was performed between the yarn feed roller 9 and the first drawing rollers 10 to attain a rotational speed ratio of 2.8 therebetween and, subsequently, a second stage drawing was performed between the first drawing rollers 10 and the second drawing rollers 11 to attain a rotational speed ratio of 1.4 therebetween. Subsequently, a third stage drawing was performed between the second drawing rollers 11 and the third drawing rollers 12.

Subsequently, 8% relaxation heat treatment was conducted between the third drawing rollers 12 and the relaxation rollers 13, and the yarn was interlaced by the interlacing device and, thereafter, wound up by the winder 15. In this example, the total draw ratio represented by the ratio of the take-up speed and the drawing speed was adjusted to a ratio shown in Table 2. The surface temperatures of the respective rollers were set to ordinary temperature for the take-up rollers, 45° C. for the yarn feed roller, 107° C. for the first drawing rollers, 170° C. for the second drawing rollers, 197° C. for the third drawing rollers and 144° C. for the relaxation rollers. The interlacing treatment was performed by injecting high-pressure air from a direction perpendicular to the travelling yarn in the interlacing device. The guides for regulating the travelling yarn were provided before and after the interlacing device, and the pressure of the air to be injected was constant at 0.3 MPa.

TABLE 1

| | Item | Unit | Example 1 | Example 2 | Example 3 | Example 4 | Example 5 | Example 6 | Example 7 | Example 8 | Example 9 |
|---|---|---|---|---|---|---|---|---|---|---|---|
| | Draw ratio | | 5.2 | 5.3 | 5.3 | 5.0 | 5.1 | 4.3 | 4.8 | 5.0 | 5.4 |
| | Spinning speed | m/min | 577 | 566 | 566 | 600 | 588 | 698 | 625 | 600 | 556 |
| Chip | Polymer species | — | N610 | N610 | N610 | N610 | N610 | N610 | N610 | N610 | N610 |
| | Sulfuric acid relative viscosity | — | 3.8 | 3.8 | 3.8 | 3.8 | 3.7 | 3.8 | 3.8 | 3.8 | 3.8 |
| | Moisture percentage | % | 0.05 | 0.09 | 0.13 | 0.02 | 0.02 | 0.09 | 0.09 | 0.09 | 0.09 |
| Raw yarn | Sulfuric acid relative viscosity | — | 3.6 | 3.4 | 3.3 | 3.7 | 3.6 | 3.5 | 3.5 | 3.5 | 3.5 |
| | Total fineness | dtex | 466 | 468 | 470 | 475 | 467 | 467 | 465 | 472 | 470 |
| | Number of single filaments | filaments | 48 | 48 | 48 | 48 | 48 | 48 | 48 | 48 | 48 |
| | Number of single filament fineness | dtex | 9.7 | 9.8 | 9.8 | 9.9 | 9.7 | 9.7 | 9.7 | 9.8 | 9.8 |
| | Strength | cN/dtex | 8.9 | 8.9 | 8.7 | 8.9 | 8.9 | 7.3 | 8.0 | 8.3 | 9.2 |
| | Elongation | % | 20 | 22 | 21 | 20 | 20 | 30 | 25 | 24 | 20 |
| | Strength-elongation product | cN/dtex × √ % | 40.1 | 41.7 | 39.4 | 39.6 | 39.8 | 40.2 | 40.0 | 41.0 | 40.8 |
| | Number of fluffs | /10000 m | 1 | 0 | 3 | 4 | 4 | 0 | 0 | 0 | 1 |
| | Number of fluffs *1 | /10000 m | 1 | 0 | 3 | 4 | 4 | 0 | 0 | 1 | 1 |
| | Wet tenacity/dry tenacity | — | 0.98 | 0.98 | 0.98 | 0.98 | 0.98 | 0.98 | 0.98 | 0.98 | 0.98 |

*1 The number of fluffs at a strength of 8.7 cN/dtex

TABLE 2

| | Item | Unit | Example 10 | Example 11 | Example 12 | Example 13 | Comparative Example 1 | Comparative Example 2 | Comparative Example 3 | Reference Example 1 | Reference Example 2 |
|---|---|---|---|---|---|---|---|---|---|---|---|
| | Draw ratio | | 5.0 | 5.2 | 4.9 | 5.1 | 5.1 | 5.4 | 4.9 | 4.9 | 4.8 |
| | Spinning speed | m/min | 562 | 544 | 571 | 400 | 586 | 556 | 612 | 624 | 629 |
| Chip | Polymer species | — | N610 | N610 | N610 | N610 | N610 | N610 | N610 | N66 | N6 |
| | Sulfuric acid relative viscosity | — | 3.8 | 3.8 | 3.8 | 3.8 | 3.9 | 3.2 | 4.0 | 3.8 | 3.8 |
| | Moisture percentage | % | 0.07 | 0.07 | 0.09 | 0.06 | 0.02 | 0.02 | 0.02 | 0.08 | 0.02 |
| Raw yarn | Sulfuric acid relative viscosity | — | 3.5 | 3.5 | 3.5 | 3.5 | 3.8 | 3.1 | 3.9 | 3.8 | 4.0 |
| | Total fineness | dtex | 981 | 1395 | 1878 | 875 | 468 | 470 | 484 | 1400 | 1402 |
| | Number of single filaments | filaments | 204 | 204 | 306 | 28 | 48 | 48 | 48 | 204 | 204 |
| | Number of single filament fineness | dtex | 4.8 | 6.8 | 6.1 | 31.3 | 9.8 | 9.8 | 10.1 | 6.9 | 6.9 |
| | Strength | cN/dtex | 8.7 | 8.8 | 8.7 | 7.4 | 8.6 | 8.3 | 8.3 | 8.43 | 8.48 |
| | Elongation | % | 23 | 22 | 23 | 25 | 20 | 20 | 19 | 23 | 26 |
| | Strength-elongation product | cN/dtex × √ % | 41.4 | 41.6 | 41.6 | 36.9 | 38.6 | 37.1 | 36.4 | 40.4 | 42.8 |
| | Number of fluffs | /10000 m | 1 | 1 | N.D. *2 | N.D. *2 | 6 | 5 | 7 | 0 | 2 |
| | Number of fluffs *1 | /10000 m | 1 | 1 | N.D. *2 | N.D. *2 | 7 | 7 | 10 | 1 | 3 |
| | Wet tenacity/dry tenacity | — | 0.98 | 0.98 | 0.98 | 0.98 | 0.98 | 0.98 | 0.98 | 0.87 | 0.88 |

*1 The number of fluffs at a strength of 8.7 cN/dtex

*2 No data because of non-measurement

INDUSTRIAL APPLICABILITY

A low water-absorbing polyamide 610 multifilament having high strength and excellent fluff quality can be provided. Hence, the features of a polyamide 610 multifilament due to water absorption and moisture absorption are made the most of, and the applications of the polyamide 610 multifilament can be further expanded.

While our multifilaments and methods have been described in detail and with reference to specific examples, it will be apparent to those skilled in the art that various changes and modifications may be made without departing from the spirit and scope of the appended claims.

This application is based on Japanese Patent Application No. 2018-31834 filed on Feb. 26, 2018, the subject matter of which is incorporated herein by reference.

The invention claimed is:

1. A polyamide 610 multifilament having a sulfuric acid relative viscosity of 3.3 to 3.7, a strength of 7.3 cN/dtex to 9.2 cN/dtex and an elongation of 20% to 30%, wherein the polyamide 610 multifilament is produced from a chip of polyamide 610 at a take-up speed of 350 to 1100 m/min and a draw ratio of 3 to 6, wherein the chip has a sulfuric acid relative viscosity of 3.6 to 4.0 and a moisture content of 0.05% to 0.13%.

2. The polyamide 610 multifilament according to claim 1, wherein the number of fluffs is 0/10000 m to 4/10000 m.

3. The polyamide 610 multifilament according to claim 1, wherein a total fineness is 420 dtex to 1500 dtex.

4. The polyamide 610 multifilament according to claim 1, wherein the wet tenacity/dry tenacity is 0.90 or more.

5. The polyamide 610 multifilament according to claim 1, wherein the strength-elongation product is 35 cN/dtex×√% or more.

6. The polyamide 610 multifilament according to claim 1, wherein the number of single filament fineness is 4 dtex to 35 dtex.

7. The polyamide 610 multifilament according to claim 2, wherein a total fineness is 420 dtex to 1500 dtex.

8. The polyamide 610 multifilament according to claim 2, wherein the wet tenacity/dry tenacity is 0.90 or more.

9. The polyamide 610 multifilament according to claim 2, wherein the strength-elongation product is 35 cN/dtex×√% or more.

10. The polyamide 610 multifilament according to claim 2, wherein the number of single filament fineness is 4 dtex to 35 dtex.

11. The polyamide 610 multifilament according to claim 3, wherein the wet tenacity/dry tenacity is 0.90 or more.

12. The polyamide 610 multifilament according to claim 3, wherein the strength-elongation product is 35 cN/dtex×√% or more.

13. The polyamide 610 multifilament according to claim 3, wherein the number of single filament fineness is 4 dtex to 35 dtex.

14. The polyamide 610 multifilament according to claim 4, wherein the strength-elongation product is 35 cN/dtex×√% or more.

15. The polyamide 610 multifilament according to claim 4, wherein the number of single filament fineness is 4 dtex to 35 dtex.

16. The polyamide 610 multifilament according to claim 1, wherein (a sulfuric acid relative viscosity of a chip) — (a sulfuric acid relative viscosity of a raw yarn) is −0.2, −0.3, −0.4 or −0.5.

17. The polyamide 610 multifilament according to claim 1, wherein the number of fluffs is 0/10000 m to 3/10000 m.

* * * * *